US008573940B2

(12) United States Patent
Pickens et al.

(10) Patent No.: US 8,573,940 B2
(45) **Date of Patent: *Nov. 5, 2013**

(54) INTERLOCKING KNIFE EDGE SEALS

(75) Inventors: John T. Pickens, Middletown, CT (US); Tuy Tran, West Hartford, CT (US); Allan R. Penda, Amston, CT (US)

(73) Assignee: United Technologies Corporation, Hartford, CT (US)

( * ) Notice: Subject to any disclaimer, the term of this patent is extended or adjusted under 35 U.S.C. 154(b) by 1421 days.

This patent is subject to a terminal disclaimer.

(21) Appl. No.: 11/482,420

(22) Filed: Jul. 7, 2006

(65) Prior Publication Data

US 2008/0008582 A1 Jan. 10, 2008

(51) Int. Cl.
*F01D 11/12* (2006.01)

(52) U.S. Cl.
USPC ..... 416/198 A; 416/201 R; 415/173.7; 415/174.4; 415/174.5; 29/889.2

(58) Field of Classification Search
USPC ..... 415/173.4, 173.5, 173.7, 174.4, 174.5, 415/199.5, 230, 231; 416/198 R, 198 A, 416/200 R, 200 A, 201 R, 201 A; 277/411, 277/412, 413, 416, 421; 29/888.02, 29/888.021, 889.2
See application file for complete search history.

(56) References Cited

U.S. PATENT DOCUMENTS

| | | | | | |
|---|---|---|---|---|---|
| 1,792,288 | A * | 2/1931 | Dempster | ..... | 277/416 |
| 3,067,490 | A * | 12/1962 | Luthy et. al. | ..... | 29/889.2 |
| 3,295,825 | A * | 1/1967 | Hall, Jr. | ..... | 415/173.7 |
| 3,701,536 | A * | 10/1972 | Matthews et. al. | ..... | 277/415 |
| 4,088,422 | A * | 5/1978 | Martin | ..... | 416/198 A |
| 7,216,871 | B1 * | 5/2007 | Datta | ..... | 277/416 |
| 7,470,113 | B2 * | 12/2008 | Tran et al. | ..... | 416/198 A |
| 2007/0297897 | A1 * | 12/2007 | Tran et al. | ..... | 415/170.1 |

* cited by examiner

*Primary Examiner* — Christopher Verdier
(74) *Attorney, Agent, or Firm* — Carlson, Gaskey & Olds, PC

(57) ABSTRACT

A compressor for a turbine engine includes multiple compressor disks having rotor blades mounted about the circumference of each of the disks. A plurality of stator blades extend between the rotor blades of axially adjacent disks. A knife edge seal is supported and retained by retaining flanges extending from a rim on each disk, and contacts the stator blades to limit the recirculation of air within the compressor. A plurality of lock assemblies are spaced about the circumference of disk backbones formed in each disk, with a plurality of knife edge seals located between each lock assembly. When in the lock position the lock assemblies reduce the slack used for assembly of the final knife edge seal to prevent shifting and rotating during operation.

12 Claims, 4 Drawing Sheets

INTERLOCKING KNIFE EDGE SEALS

BACKGROUND OF THE INVENTION

The invention generally relates to an arrangement for loading and retaining knife edge seals within a compressor.

Turbine engines include high and low pressure compressors to provide compressed air for combustion within the engine. Each compressor typically includes multiple rotor disks. Stator blades extend between each rotor disk along a compressor axis. Knife edge seals are formed integrally into each rotor disk to contact the stator blades. The seals limit the recirculation of air within the compressor.

During operation of the compressor the rotor disk is repeatedly heated and cooled, resulting in compressive and tensile hoop stresses on the outer portion of the disk, including the knife edge seals. This cyclic loading from the thermal cycles fatigue the disk and knife edge seals. Any areas of concentrated stress are prone to cracking as a result of the fatigue. The hoop stress in the knife edge seals can practically be eliminated by making the knife edge seals non-integral to the disk, and segmented. This will increase the durability of the rotor.

An improved arrangement for loading and retaining knife edge seals within a compressor is needed.

SUMMARY OF THE INVENTION

An example compressor for a turbine engine according to this invention includes an arrangement for incorporating knife edge seals which are separate from the compressor disk.

A typical compressor includes multiple rotor disks having rotor blades mounted about the circumference of each of the disks. A plurality of stator blades extend axially between adjacent disks. A knife edge seal assembly is supported and retained by retaining flanges extending from a rim on each disk. The assembly is formed from a plurality of knife edge seals arranged about the circumference of a disk backbone of the disk assembly. The knife edge seals contact the stator blades to limit the recirculation of air within the compressor. Each knife edge seal has an over-lapping lip which prevents the air leakage between the seals.

To assemble the knife edge seals a lower seal body is inserted past retaining flanges on the disks and the knife edge seal is then rotated 90-degrees. Once rotated, grooves between the lower seal body and an upper seal body engage the retaining flanges. Consecutive knife edge seals are assembled in the same manner and pressed together to interlock with the circumferentially adjacent knife edge seal. A lock assembly is inserted between the retaining flanges in a similar manner to the knife edge seal. The lock assemblies and the knife edge seals are inserted until all have been assembled onto the disk. Slack is left to provide enough room for the last knife edge seal to be assembled. Upon completion the lock assemblies should be spaced from one another about the circumference of the disk backbone with a plurality of knife edge seals located between each lock assembly. Once all the knife edge seals have been assembled the slack used for assembly of the final knife edge seal must be reduced to prevent shifting and rotating of the knife edge seals during operation of the compressor. A set screw on each lock assembly is tightened, moving the lock assembly into a lock position. The lock assembly contacts the adjacent knife edge seals when locked to reduce the slack. The lock assemblies each include a rounded end of the set screw. The disk backbone includes a mating depression to prevent rotation of the lock assembly during compressor operation.

These and other features of the present invention can be best understood from the following specification and drawings, the following of which is a brief description.

DETAILED DESCRIPTION OF THE PREFERRED EMBODIMENT

Figure 1:
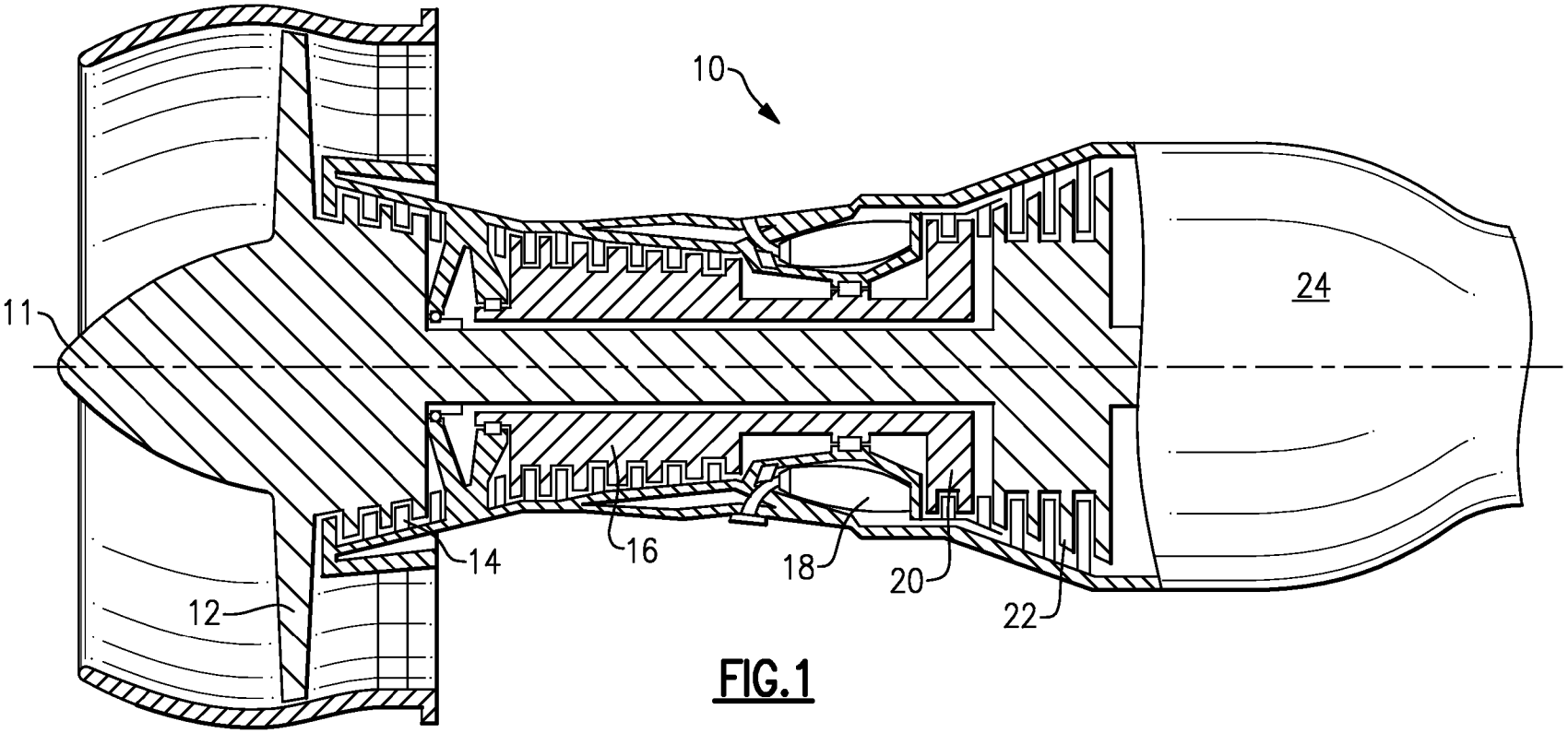
FIG. 1 is a schematic view of an example turbine engine of the present invention.

FIG. 1 is a schematic view of a turbine engine 10. Air is pulled into the turbine engine 10 by a fan 12 and flows through a low pressure compressor 14 and a high pressure compressor 16. Fuel is mixed with the oxygen and combustion occurs within the combustor 18. Exhaust from combustion flows through a high pressure turbine 20 and a low pressure turbine 22 prior to leaving the engine through the exhaust nozzle 24.

Figure 2:
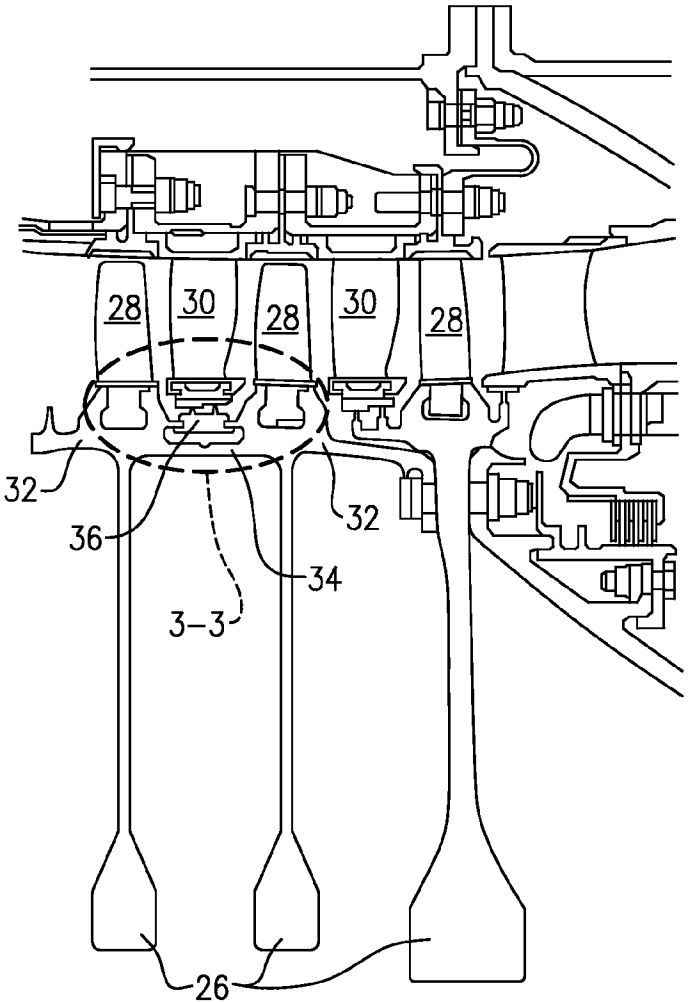
FIG. 2 illustrates a portion of a cross-section of a typical compressor for the example turbine engine of the present invention.

FIG. 2 illustrates a portion of a cross-section of a typical compressor including multiple disks 26 defining a compressor rotor. Each disk 26 rotates about an axis located along the centerline 11 of the turbine engine 10. A plurality of rotor blades 28 are mounted about the circumference of each of the disks 26. A plurality of stator blades 30 extend between the rotor blades 28 of axially adjacent disks 26, as shown.

Each disk 26 includes a disk rim 32. The disk rim 32 supports the rotor blades 28. A disk backbone 34 extends from each disk rim 32. A knife edge seal 36 is supported and retained by both of retaining flanges 38*a* and 38*b* (FIG. 3) which extend from each axially adjacent disk rim 32. The knife edge seal segments 36 are preferably formed of the same material as the disk 26 or other materials such as ferrous, nickel, or ceramic materials. The knife edge seal 36 contacts the stator blades 30, as shown, to limit the air circulation within the compressor. In fact, the knife edge seal 36 contacts an abradable honeycomb material 31 associated with the stator blades 30.

Figure 3:
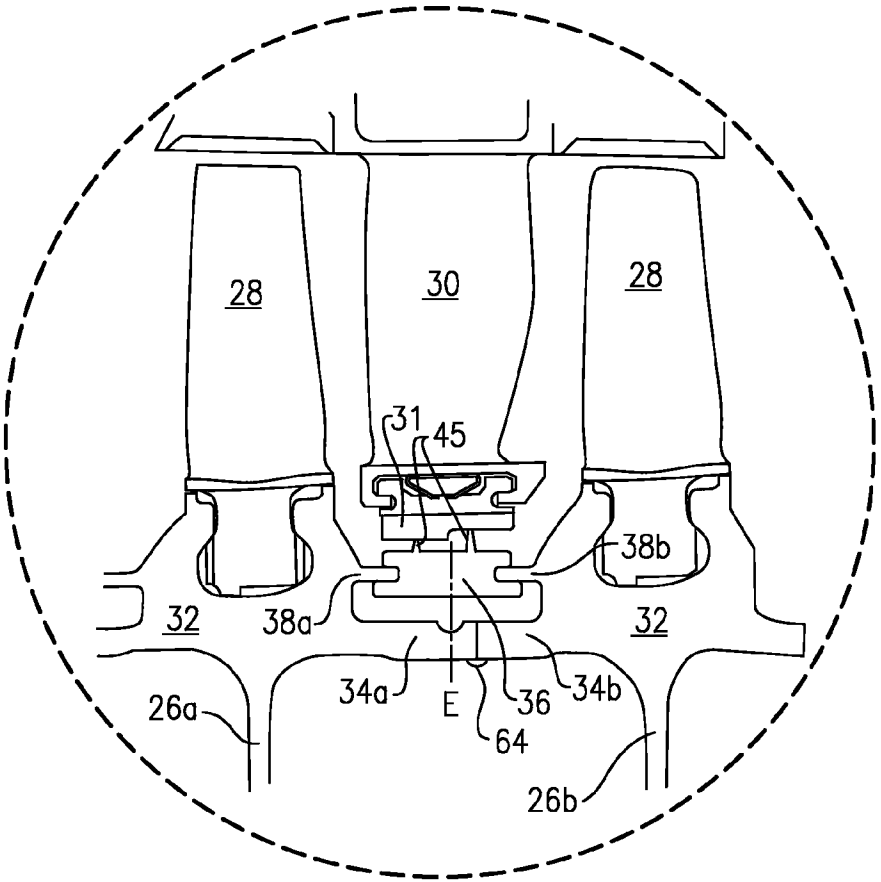
FIG. 3 is an enlarged view of section 3-3 from FIG. 2, illustrating a portion of example disks which are axially adjacent to one another.

FIG. 3 illustrates portions of example disks 26*a* and 26*b* which are axially adjacent to one another. A disk backbone 34*a* on the disk 26*a* is in contact with a disk backbone 34*b* of the axially adjacent disk 26*b*. The disk backbone 34*a* is preferably welded to the disk backbone 34*b*, illustrated by weld bead 64. However, the disk backbone 34*a* and the disk backbone 34*b* can also be bolted together or secured in another know manner. A retaining flange 38*a* extends from the disk 26*a* and a retaining flange 38*b* extends from the disk 26*b*. A plurality of knife edge seals 36 are arranged about the circumference of the disk backbones 34*a* and 34*b*. Each knife edge seal 36 is supported and retained by both the retaining flanges 38*a* and 38*b*.

Figure 5:
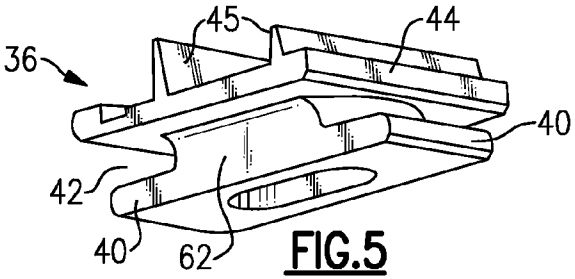
FIG. 5 is a perspective view of an example knife edge seal of the present invention.
Figure 4A:
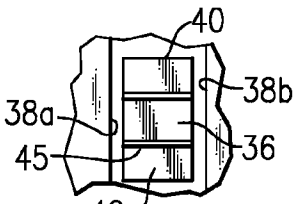
FIG. 4A is a top view of an example knife edge seal inserted on the disk backbone prior to rotation.
Figure 4:
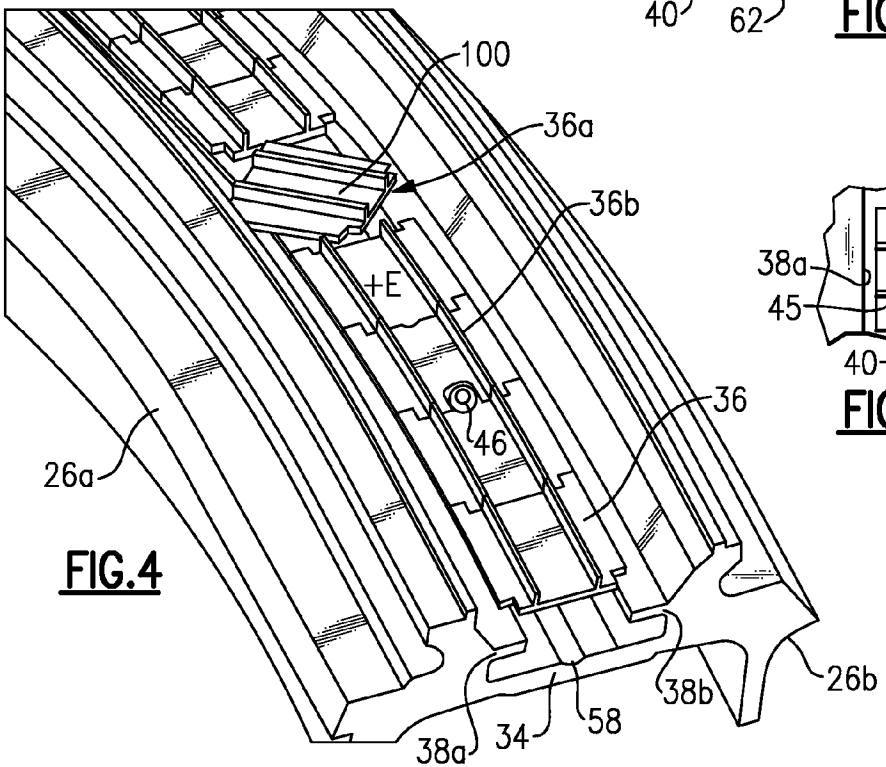
FIG. 4 is a perspective view of a portion of the example disks of the present invention.

Referring to FIG. 4, a perspective view of a portion of the disks 26*a* and disk 26*b* is shown. Details of the knife edge seals 36 can be seen in FIG. 5. As shown in FIG. 4A, to assemble the knife edge seals 36 lower seal body ears 40 are inserted past the retaining flanges 38*a* and 38*b* with the knife edge seal 36 oriented such that ears 40 extend parallel to flanges 38*a* and 38*b*. The knife edge seal 36 is then rotated, 90-degrees from the FIG. 4 position, about an edge seal axis E. A knife edge seal 36*a* which has been inserted between the retaining flanges 38*a* and 38*b* and only partially rotated about the edge seal axis E is shown at 100. Once rotated the knife edge seal 36 is prevented from movement past the retaining flanges 38*a* and 38*b*. Grooves 42 between the lower seal body ears 40 and the upper seal body 44 engage the retaining flanges 38*a* and 38*b*. The upper seal body 44 overlaps the retaining flanges 38*a* and 38*b* to minimize leakage past the knife edge seals 36 between the disks 26*a* and 26*b*. Knife edges 45 protrude from the upper seal body 44 to contact the stator blade 30. Preferably, there are multiple knife edges 45 extending from each upper seal body 44. Once assembled the knife edge seals 36 mate with each other by tab 41 interlocking with step 43 to provide a rigid structure. The tab 41 is overlapping step 43 to minimize leakage between the knife edge seals 36. Stress placed on disk 26 during compressor operation does not transfer to the knife edge seal 36 because the knife edge seals 36 are separate elements from the disks 26. The arrangement also allows for replacement of individual knife edge seals 36 without requiring an entire new disk 26.

Figure 6:
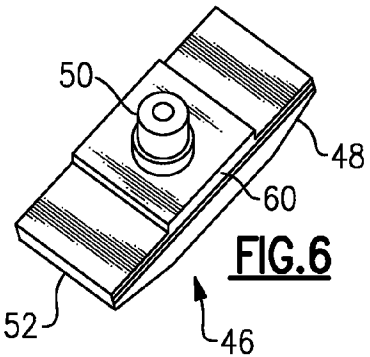
FIG. 6 is a perspective view of an example lock assembly of the present invention.

An example of the assembly process of the knife edge seals 36 onto the disk backbones 34*a* and 34*b* is described. A lock assembly 46 is inserted between the retaining flanges 38*a* and 38*b*. The lock assembly 46, shown in FIG. 6, includes a lock housing 48 and a set screw 50. The lock assembly 46 is assembled in a similar manner to the knife edge seal 36. That is, the lock assembly 46 is inserted past the retaining flanges 38*a* and 38*b* and rotated 90-degrees about the edge seal axis E. After the lock assembly 46 is rotated the lock housing 48 interferes with and is prevented from movement past the retaining flanges 38*a* and 38*b*. The lock housing 48 has chamfers 52 to provide a surface for contacting the retaining flanges 38*a* and 38*b*. During assembly of the knife edge seals 36 the lock assembly 46 remains in a released position.

The process of inserting the lock assemblies 46 and knife edge seals 36 is repeated until all the knife edge seals 36 and lock assemblies 46 have been assembled onto the disk 26. The lock assemblies 46 should be assembled to be spaced from one another about the circumference of the disk backbones 34*a* and 34*b*. A plurality of knife edge seals 36 should be located between each lock assembly 46. Slack is left to provide enough room for the last knife edge seal 36 to be assembled. That is, to provide enough space to insert and then rotate the knife edge seal 36 into position.

In one example, there are eight lock assemblies 46. The number of lock assemblies 46 and the number and length of the knife edge seals 36 may vary. One skilled in the art would be able to determine the appropriate numbers and lengths of knife edge seals 36 and lock assemblies 46.

Figure 8:
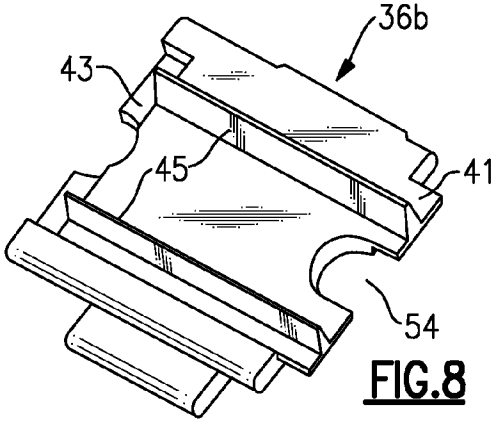
FIG. 8 is a perspective view of an example knife edge seal for assembly adjacent to the lock assembly of the present invention.
Figure 7:
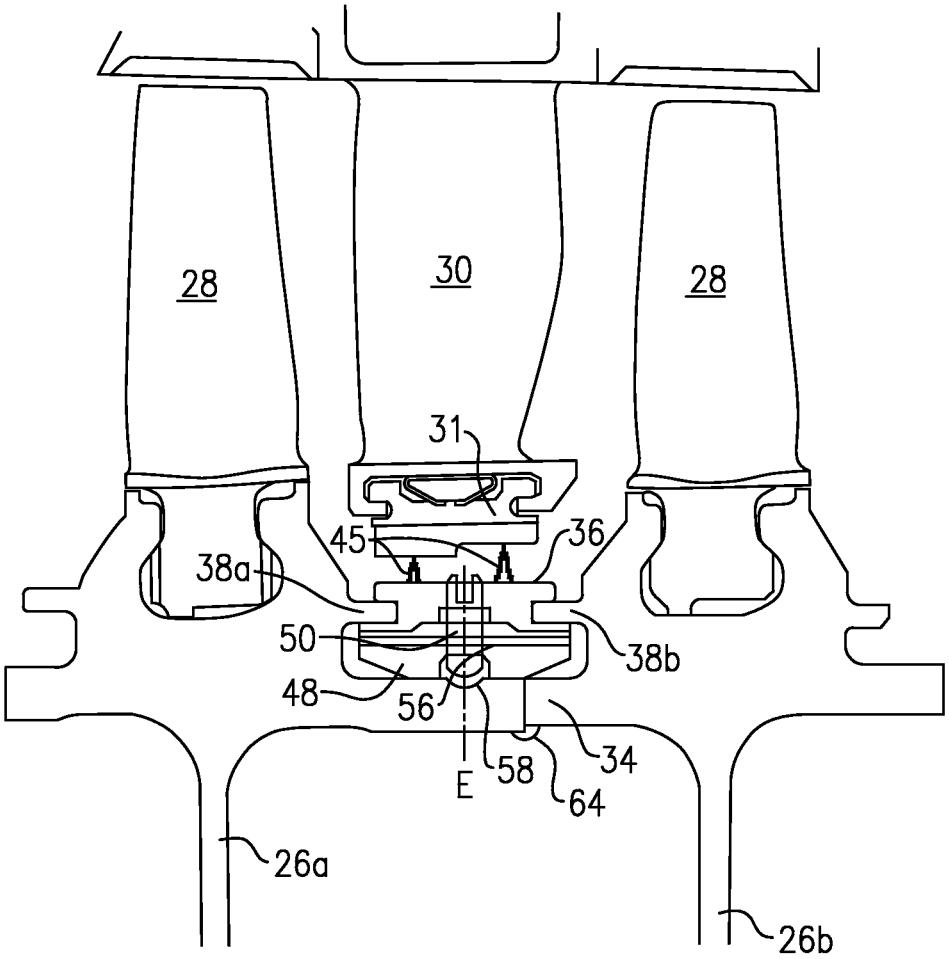
FIG. 7 is a cross-section of axially adjacent example disks where the lock assembly of FIG. 6 is in a lock position.

Referring to FIG. 7, once all the knife edge seals 36 have been assembled the slack used for assembly of the final knife edge seal 36 must be reduced to prevent the knife edge seals 36 from shifting and rotating during operation. The lock assemblies 46 can be moved from the released position to the locked position. The set screw 50 on each lock assembly 46 is tightened moving the lock assembly 46 into the lock position. To provide clearance for the protruding set screw 50 the knife edge seals 36*b*, shown in FIG. 8, adjacent to the lock assemblies 46 each define a lock interfitting portion 54. The lock interfitting portion 54 has a complementary shape to the portion of lock housing 48 which contacts the knife edge seal 36*b*. When the lock assembly 46 is moved to the locked position the set screw 50 acts against the disk backbone 34*a* to push the lock housing 48 upward from the disk backbone 34*a*. The upward movement the lock housing 48 causes the sides of the lock housing 60 to contact the sides 62 of the adjacent knife edge seal 36. The contact pushes the knife edge seals 36 away from each other reducing the slack.

The lock assemblies 46 each include a first interlocking feature 56 and the disk backbone 34*a* includes a second interlocking feature 58. When the lock assemblies 46 are in the lock position the first interlocking feature 56 and the second interlocking feature 58 lock together to prevent circumferential movement of the lock assemblies 46. In the example shown the first interlocking feature 56 is a rounded end of set screw 50 and the second interlocking feature 58 is a depression in the disk backbone 34*a*. The second interlocking feature 58 may be a continuous depression or a plurality of depressions spaced around the circumference of the disk backbone 34*a* at desired location. Of course, the second interlocking feature 58 may be formed in the second disk backbone 34*b*, or partially formed in both the first and second disk backbones 34*a* and 34*b*

Although the example embodiment discloses an arrangement of assembling knife edge seals onto a rotor disk for a compressor the arrangement may be used for any rotor and seal assembly.

Although the disclosure shows a plurality of several of the structures, the claims may be broader than requiring a plurality of the structures, and may recite that "at least one" of the structures exist in the claimed structure. This may apply to the knife edge seals, the disk backbones, or the lock assemblies.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

a plurality of disks each defining a disk rim having a disk backbone and a retaining flange protruding from the disk rim, and said disks centered about a central axis;

a plurality of knife edge seals circumferentially spaced about a circumference of the disk rims, wherein each of the plurality of knife edge seals are supported and retained by a retaining flange from each of two of said plurality of disks;

a plurality of lock assemblies are positioned between the plurality of knife edge seals and the disk backbones; and the plurality of lock assemblies each comprise a housing and a set screw movable between a released position and a lock position to prevent circumferential movement of the plurality of knife edge seals about the disk backbones when the lock assembly is in the lock position.

2. The compressor of claim 1, wherein the plurality of lock assemblies are spaced about a circumference of the disk backbones and a portion of the plurality of knife edge seals are located between each of the lock assemblies.

3. The compressor of claim 1, wherein the set screw provides a first interlocking feature and the disk backbones each include a second interlocking feature, and the first interlocking feature locks with the second interlocking feature when the plurality of lock assemblies are in the lock position.

4. A turbine engine seal comprising:

a seal having a body defining a knife edge protruding from the body for contacting another turbine engine component;

a first projection extending from the body in a first direction, wherein the first projection is for locating next to a first disk;

a second projection extending from the body in a second direction, opposing the first direction, wherein the second projection is for locating next to a second disk, opposing the first disk, such that the seal is positionable between the first disk and the second disk;

said body having distinct interlocking structure at each of two opposed circumferential ends such that said interlocking structure at a first circumferential end can interlock with mating interlocking structure at a second circumferential end of an adjacent seal;

at least one lock assembly associated with the seal and moveable between a locked position and a released position; and the at least one lock assembly comprises a housing and a set screw movable between a released position and a lock position.

5. The turbine engine seal of claim 4, wherein the seal is to be supported and retained by both the first and the second disk.

6. The turbine engine seal of claim 4, wherein the at least one lock assembly retains the seal to prevent circumferential movement of the seal about the first disk and the second disk when the at least one lock assembly is in the lock position.

7. The turbine engine seal of claim 4, wherein there are a plurality of lock assemblies to be spaced about the circumference of the first disk and a plurality of seals located between each of the lock assemblies.

8. The turbine engine seal of claim 4, wherein the seal is for use in a compressor and the knife edge is to contact a portion of a stator.

9. The turbine engine seal of claim 4, wherein said interlocking structure at one circumferential end being a tab, with the interlocking structure at the second circumferential end being a step, and said tab and said step being shaped to be at different radial distances away from a central axis of a disk which will receive the seal.

10. A method of assembling a compressor comprising:

a) placing a lock assembly between a first retaining flange protruding from a first rotor disk and a second retaining flange protruding from a second rotor disk;

b) inserting a plurality of knife edge seals circumferentially adjacent to one another between the retaining flanges, inserting each of the knife edge seals between the first retaining flange and the second retaining flange and rotating the knife edge seal relative to the first and second retaining flanges;

c) repeating said steps a) and b) until the first rotor disk and the second rotor disk are filled; and d) locking each of the lock assemblies to prevent circumferential motion of the plurality of knife edge seals.

11. The method of claim 10, wherein step c) comprises placing the first rotor disk and the second rotor disk adjacent one another along a common axis such that a first disk backbone protrudes from the first rotor disk in a first direction and a second disk backbone protrudes from the second rotor disk in a second direction, opposing the first direction, such that the first disk backbone and the second disk backbone are in contact with one another.

12. The method of claim 10, wherein step d) comprises tightening a set screw in each lock assembly to move a lock assembly housing through a hole in the associated knife edge seal to cause the knife edge seal to contact the first retaining flange and the second retaining flange.

* * * * *